United States Patent [19]

Jürgens

[11] 4,133,516

[45] Jan. 9, 1979

[54] SHOCK ABSORBER FOR WELL DRILLING PIPE

[75] Inventor: Rainer Jürgens, Celle, Fed. Rep. of Germany

[73] Assignee: Christensen, Inc., Salt Lake City, Utah

[21] Appl. No.: 820,211

[22] Filed: Jul. 29, 1977

[30] Foreign Application Priority Data

Oct. 22, 1976 [DE] Fed. Rep. of Germany ..... 2647810

[51] Int. Cl.[2] ..... F16F 5/00

[52] U.S. Cl. ..... 267/125; 64/23; 175/321

[58] Field of Search ..... 64/11 R, 13, 23; 267/125, 166; 175/320, 321

[56] References Cited

U.S. PATENT DOCUMENTS

| | | | |
|---|---|---|---|
| 3,225,566 | 12/1963 | Leathers | 64/23 |
| 3,606,297 | 9/1971 | Webb | 267/125 |
| 3,963,228 | 6/1976 | Karle | 267/125 X |
| 4,055,338 | 10/1977 | Dyer | 267/125 |

*Primary Examiner*—Duane A. Reger
*Attorney, Agent, or Firm*—Bernard Kriegel; Philip Subkow

[57] ABSTRACT

A shock absorber assembly has an outer body connectible at one end in a well drill string and an inner body connectible at one end in the well drilling string, with the bodies telescopically coengaged. Between the bodies is an annular space, filled with hydraulic fluid and containing a pressure equalizing annular piston. Stacked sets of dished-spring washers are disposed in coengaged frictional relation to form parallel-acting columns in the annular space between the two bodies. The equalizing piston is exposed to the pressure of drilling fluid inside the inner body, in one form, and outside the outer body, in another form. Another equalizing piston defines between the bodies a fluid filled chamber containing torque transmitting means for causing the bodies to rotate as a unit during drilling operations while allowing telescopic extension and retraction of the bodies. Telescoping of the bodies causes fluid transfer through restricted passages to dampen the telescopic motion.

34 Claims, 8 Drawing Figures

SHOCK ABSORBER FOR WELL DRILLING PIPE

This invention relates to a shock absorber for deep hole well drilling pipe which can be installed in the drill pipe string. Heretofore, such shock absorber devices have been provided comprising an outer tubular body and an inner tubular body which are telescopically coengaged and movable relative to one another, but which are secured against relative rotation by torque transmitting or transfer means. The tubular bodies of such devices define between them an annular space or chamber filled with hydraulic fluid, and support spring means in the annular space for shock absorption and attenuation. The annular chamber is sealed by an upper seal and a lower seal, the lower seal comprising an equalizer piston independently movable coaxially within limits, between the outer and inner bodies, its bottom end being exposed to fluid in an equalizing chamber for the hydraulic fluid in the annular space.

In one known shock absorber of this type, the spring elements consist of flat washers made of an elastomer material, in particular polyurethane, stacked on top of each other to form a single column, by interposing therebetween metal absorption discs. The elastic deformability of the elastomer rings may impart to such a shock absorber strokes of about 30 to 100 mm, depending on the design, with a desired soft spring characteristic and a favorable attenuating action resulting from the self-damping properties of the elastomer material.

Hydraulic fluid in an annular chamber, which accomodates the torque transfer or splined connection between the bodies, due to an equalizer piston exposed to drilling fluid pressure in the drill pipe, is effective as a lubricant in the area of the torque transfer means. The piston equalizes pressure in the annular chamber with the pressure in both the drill pipe and the well bore, the equalizer piston automatically causing the matching of pressures and, if necessary, compensating for hydraulic fluid loss.

Such shock absorbers, designed to dampen the drill bit vibrations reacting on the drill pipe and to reduce the high dynamic stresses of the drill pipe resulting from such vibrations, as well as to equalize the drill bit pressure in the interest of increased drilling speed, have proven out well in both deep and shallow holes, within wide speed ranges, and also under difficult drilling conditions, but their application is restricted to holes in which drill hole temperatures of about 100° C. to 130° C. are not exceeded, and relatively large outside diameters of the drill pipe and thence of the shock absorber are utilized. The pressure of drilling fluid in the drill pipe also limits the applicability of such shock absorbers because this pressure acts upon the hydraulic fluid in the annular chamber and generates in the hydraulic fluid an axially operating expansive force between the outer and inner pipe parts, which may exceed the drill bit load and lead to the outer and inner pipe bodies being telescopically separated so that the shock absorber acts like a relatively rigid element.

It is an object of the present invention to provide a shock absorber of the kind generally described above, with improved spring and damping characteristics, and which can also be utilized in the drilling of relatively deep hot bore holes in the high temperature range, and which can be built with relatively small cross sectional dimensions.

The invention provides a shock absorber for well drilling strings of the above described type, wherein spring elements are divided into at least two parallel-acting spring columns which are mutually superposed and axially spaced, and housed in spring chambers within the fluid filled annular space between the telescopic bodies, the spring columns being formed of dish-type or Belleville springs of steel or a similar resilient metal, combined within each spring column into a number of equally stacked packets or sets whose stacking sense alternates from packet to packet, in an axial direction.

The shock absorber according to the invention is largely independent of temperature in its spring damping characteristics and can be used without problems in ranges of well bore temperatures reaching or exceeding 300° C. The two or more parallel spring columns divide the occurring shock loads among themselves and reduce the loads to be absorbed by the spring elements within one column, so that springs, each having a shorter spring travel, can be designed to have a smaller radial dimension, permitting the construction of shock absorbers having an outside diameter of, say, 4¾ inches, for example. Even in shock absorbers of such small cross-sectional size, the spring elements are not subjected to the danger of destruction by breakage, but assure uniformly good shock attenuation through friction between the springs, for a wide range of strokes. In addition, the shock absorbers according to the invention provide the possibility of a varying strokes, spring characteristic and damping characteristic by changing, for instance, the number of spring elements stacked the same way in one packet and adjusting them to the respectively prevailing drilling conditions.

According to a further feature of the invention, each spring chamber forms a pumping chamber of decreasing volume when the outer and inner bodies telescopically retract and of increasing volume when they extend so that, during the operation of the shock absorber, alternating axial fluid flow is impressed on the hydraulic fluid and can be utilized to achieve particular damping characteristics, especially when, in accordance with certain forms of the invention, at least one flow restrictor or damper for the hydraulic fluid flow, under the pumping action of the chambers, is provided.

Such a flow restrictor or damper may be accomplished by providing channels between the pumping chambers of suitable cross sectional dimensions, or by defined constrictions in the path of hydraulic fluid flow, such dampers exerting the same damping action in both directions of flow. However, in cases where different damping actions are desired, for the retraction and extension of the outer and inner bodies, check valve means or the like, can be employed at throttling points along the path of the hydraulic fluid flow so as to provide different damping actions, as a function of the respective flow direction of the fluid.

In combination with or independently of the features described above, the invention provides further that the annular chamber or space for the spring elements is closed off by its upper seal at a location below the torque transfer means, and that the torque transfer means are disposed in a separate hydraulic fluid-filled annular chamber or space between the outer and inner bodies, the latter chamber being closed off by an upper seal and a lower seal, the lower seal being in the form of an upper equalizer piston which is independently movable coaxially, within limits, between the outer and inner bodies, and the lower end of the latter equalizing piston closing off an equalizing chamber for the hydraulic fluid, and below the latter equalizing piston is an intermediate chamber which communicates through ports in the outer body with the well bore to expose the latter piston to the pressure of drilling fluid in the bore hole.

Such a design reduces the danger of the occurrence of so-called "through flushings" on the one hand, and the effect of axial hydraulic expansion forces operating between the outer and inner bodies on the other hand, in particular, when, according to the invention, the outside diameter of the inner body is smaller, in the area of the upper seal of the annular chamber for the spring elements, than the outside diameter of the inner body in the area of the upper seal of the annular chamber for the torque transfer means.

A further reduction of the hydraulic expansive forces can be achieved by making the outside diameter of the inner body smaller in the area of the equalizer piston below the annular chamber for the spring elements than the outside diameter of the inner body in the area of the upper seal for this annular chamber, when a lower equalizing chamber communicates through ports with the well bore below the lower equalizer piston, and when a seal is inserted between the bodies below this end chamber.

Numerous additional features and advantages follow from the claim and specifications in connection with the drawings, in which several embodiments of the subject of the invention are illustrated in greater detail.

Referring to the drawings:

FIGS. 1*a*, 1*b* and 1*c* together constitute a longitudinal quarter section of a shock absorber according to the invention, FIGS. 1*b* and 1*c* being successive downward continuations of FIG. 1*a;*

Figure 1A:
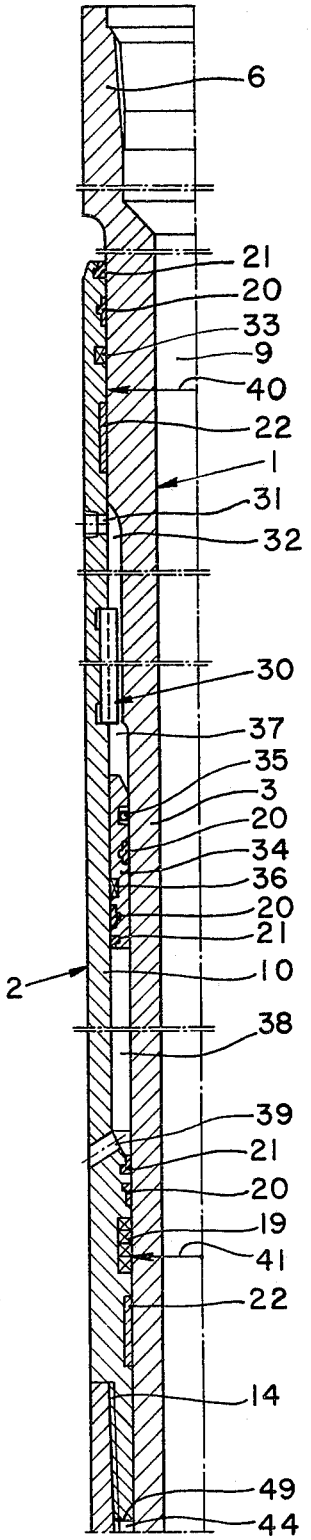
Figure 1B:
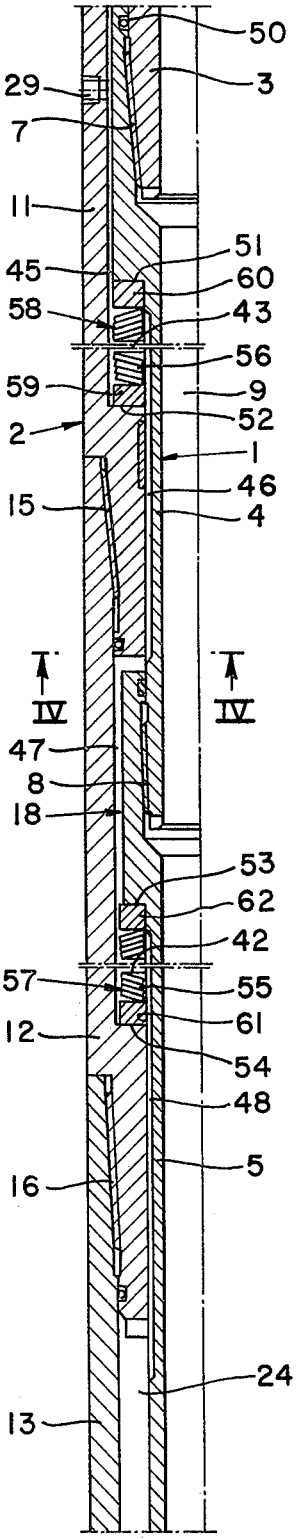
Figure 1C:
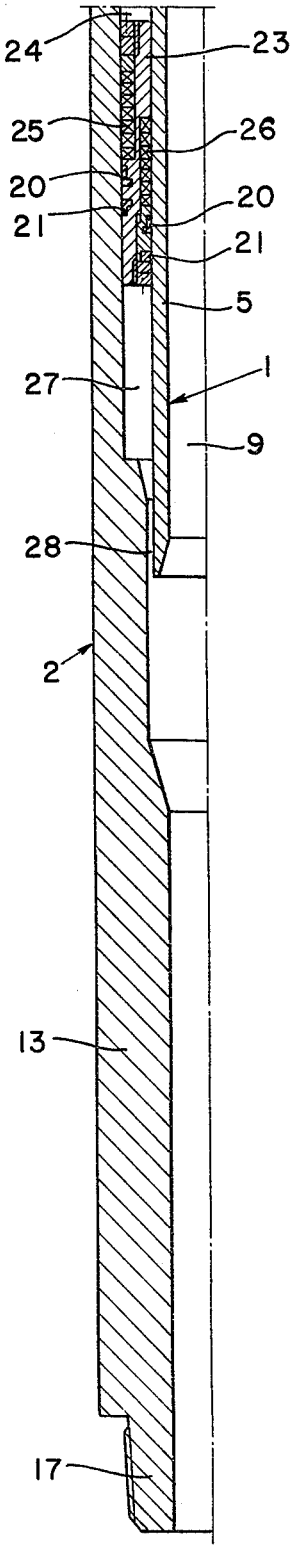

The shock absorber shown in FIGS. 1*a* through 1*c* comprises an inner pipe or tubular body 1 and an outer pipe or tubular body 2, which are telescopically engaged and adapted to be connected in the drill pipe string (not shown), for use in the rotary drilling of wells with the earth.

The inner body is composed of an upper body section 3, a central body section 4 and a lower body section 5. The upper end of the upper body section 3 is provided with an internally threaded box 6 for connection to the lower pin end of the drill pipe string (not shown) and is screwed to the central body section 4 by a tapered screw connection 7, and in turn, the central body section 4 is assembled to the lower body section 5 by a tapered screw connection 8. These interconnected inner body sections 3, 4 and 5 of the inner body 1 jointly form a central flow passage for the circulation of drilling fluid downwardly through the shock absorber, said drilling fluid returning upwardly through the well bore outside of the shock absorber.

The outer body 2 comprises an upper body section 10, two intermediate body sections 11 and 12 and a lower body section 13. A tapered screw connection 14 connects the upper body section 10 to the intermediate body section 11, and a tapered screw connection 15 connects the intermediate body section 11 to the next lower intermediate body section 12. The body section 12 and the lower body section 13 of the outer body assembly are connected by a tapered screw connection 16. The lower end of the lower body section 13 has been externally threaded connecting pin 17 for screwing to a box of the upper end of the drill string (not shown) which extends downwardly into the well bore.

The inner body assembly 1 and the outer body assembly 2 define therebetween an annular space or chamber 18, the upper end of which is closed off or defined by an upper seal or annular packing 19 slidably and sealingly engaged between the upper body sections 3 and 10. Above the packing 19 is a fine wiper 20 and above the latter a course wiper 21, these wipers also being slidably engaged between the inner and outer body sections. Suitably mounted in the upper section 10 of the outer body 2, below the seal 19, and engaged with the inner body section 3, is a bushing or wear ring 22. An annular lower equalizer piston 23 is axially movable, within limits, between the outer body 2 and the inner body 1 below an equalizing portion 24 of the annular chamber 18. The equalizer piston 23 carries on its outside and its inside, seals 25, 26, as well as fine wipers 30 and course wipers 21. Beneath the equalizer piston 23, is a lower end chamber 27 between the inner body 1 and the outer body 2, communicating, in the shock absorber design according to FIGS. 1*a* to 1*c*, with the central flow passage 9, for the circulation of drilling fluid, via an annular connecting passage 28 which opens downwardly between the inner and outer bodies.

The annular space 18 is filled with hydraulic fluid, for example, at atmospheric pressure, through a closable inlet hole 29, above ground. During the use of the shock absorber in a well drilling string, the equalizer piston 23 impresses on this hydraulic fluid in the chamber 18, the pressure of the drilling fluid in the passage 9, in the shock absorber design according to FIGS. 1*a* to 1*c*.

As may be seen from FIG. 1*a*, above the seal 19, a torque transfer means 30 is provided between the bodies 1 and 2, formed by a tongue and groove or splined system, whereby relative telescopic motion of the inner body and the outer body can occur, but the bodies are rotatable as a unit. This torque transfer means 30, disposed between the upper shock absorber body sections 3 and 10, is arranged in a separate annular chamber 32 which is located between the inner body 1 and the outer body 2 and can be filled with hydraulic fluid through a closable inlet hole 31. This chamber 32 is defined between another upper seal 33, above which is again a fine wiper 20 and a course wiper 21, and another upper annular equalizer piston 34. The upper section 10 of the outer body 2, below the upper seal 33, is provided with a bushing 22.

The upper equalizer piston 34 carries, on the inside, a seal 35, with a fine wiper 20 disposed below it, and on the outside a seal 36, with a fine wiper 20 and a course wiper 21 disposed below it. Below the spline 30, is an upper equalizing chamber 37 communicating with the chamber 32 through the spline 30. Below the piston 34 is an intermediate chamber 38 between the inner body 1 and the outer body 2, which communicates with the well bore through connecting holes 39 in the outer body. Accordingly, the pressure of the drilling fluid in the bore hole, which is less than the pressure of the drilling fluid in the drill pipe, acts upon the under side of the equalizer piston 34. Therefore, the pressure of the drilling fluid in the bore hole is impressed on the hydraulic fluid in the annular chamber 32, through the annular piston 34 and thus acts on the exposed area of the inner body 1, and is also present in the chamber 38, and thus acts on the exposed area of the outer body 2.

In the region of or at the upper seal 33 for the chamber 32, the outside diameter 40 of the inner body 1 is greater than the outside diameter 41 of the inner body in the region of or at the upper seal 19 for the annular space 18. Since only the small cross sectional area of the inner body diameter 41 is acted upon by the drilling fluid pressure prevailing in the annular chamber 18, derived from the central tool passage 9, and not the cross sectional area of the large diameter 40 in the region of the seal 33, the resulting hydraulic expansion forces applicable to the bodies in an axial direction is considerably reduced and tends to a correspondingly lesser degree to drive the inner pipe body 1 and the outer body 2 telescopically apart.

In addition to the equalizing chamber 24, within the annular space 18 are enlarged lower and upper spring chambers 42 and 43 and an additional upper piston chamber 44. All of the chambers 44, 43, 42 and 24 are interconnected by fluid passages. Passages 45 connect the upper spring chamber 43 and the upper end chamber 44. Passages 46 and 47 connect the upper spring chamber 43 and the lower spring chamber 42. Passages 48 connect the lower spring chamber 42 and the lower equalizer chamber 24. The inside and outside walls of all body parts forming the respective chambers in the annular chamber space 18 are cylindrical surfaces of the inner body 1 or the outer body 2 respectively.

The top end of the upper end chamber 44 is formed by an inwardly projecting shoulder 49 of the outer body 2, and the lower end of the chamber 44 is formed by an outwardly projecting shoulder 50 of the inner body 1. The top end of the spring chamber 43 is formed by an outwardly projecting shoulder 51 of the inner body 1, and the bottom end of chamber 43 is formed by an inwardly projecting shoulder 52 of the outer body 2. Correspondingly, shoulders 53 and 54 on the inner and outer bodies form the lower spring chamber. Due to this design, chambers 44, 43, and 42 form pumping chambers which experience changes in volume by the retraction and extension of the inner body 1 and the outer body 2 during the functioning of the shock absorber and the drilling operations, with the result that the hydraulic fluid in the annular space 18 is caused to alternately flow. This function is essential, in particular for the spring chambers 43 and 42.

Accomodated in the spring chambers are spring elements in the form of dish or Belleville type springs 55 in chamber 42 and 56 in chamber 43. These dish type springs, preferably made of steel or other metallic resilient material, are stacked inside each spring chamber to form a spring column between opposing shoulders. The dish type springs within each spring column are combined into a number of packets, stacked the same way, the stacking sense alternating in axial directions from packet to packet. It is preferred that four dish type springs are stacked in the same way to form one packet, it being possible to provide a substantial number of such packets in each spring column, for example.

The inside and outside diameters of the disc type springs are such that they loosely fit about the inner body 1 and are loosely enclosed by the outer body 2. The disc type springs 56 of the upper spring column 58 are supported between a lower supporting seat or ring 59, on top of the shoulder 52, and an upper supporting seat or ring 60, under the shoulder 51. The disc type springs 55 of the lower spring column 57 are supported in the same manner, between a lower supporting seat or ring 61, on the top of shoulder 54, and an upper supporting seat or ring 62, on the shoulder 53. In the embodiment according to FIGS. 1*a* to 1*c*, the peripheral surface of the supporting rings are flush with the respective shoulders.

Figure 2:
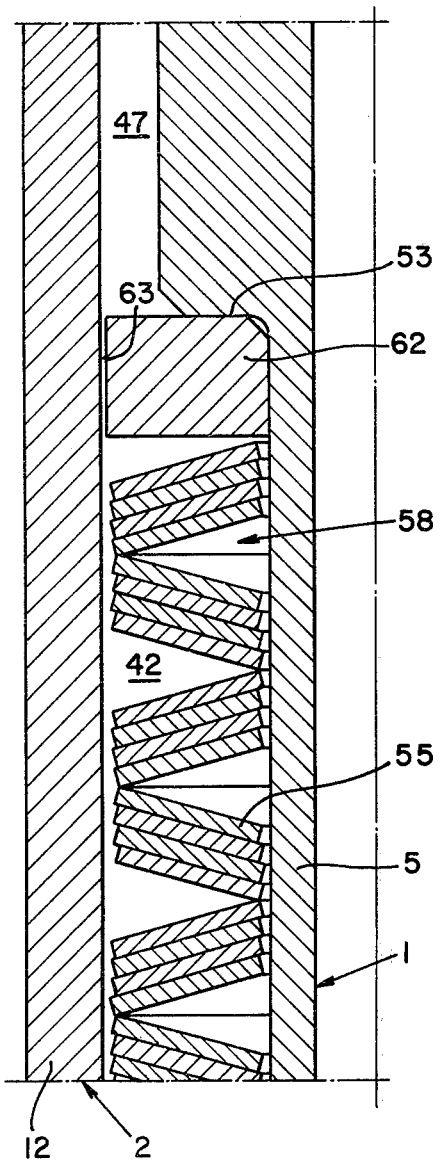
FIG. 2 is fragmentary enlarged view showing a portion of the lower spring chamber of FIG. 1*b;*

In the operation of the shock absorber, in its design according to FIGS. 1*a* to 1*c*, the dish type springs of the parallel-acting spring columns 57, 58 absorb the shock load caused by the retraction of the inner body 1 and the outer body 2 by a deformation reducing their cone angle, a part of the shock energy being absorbed and converted to heat by friction along the mutually facing coengaged dish spring surfaces. In addition to the damping resulting therefrom, a damping is brought about by means of the hydraulic fluid which, due to the pumping action of the spring chambers 42, 43 flows through passages or channels 45, 46, 47 and 48 and are subjected to a throttling action during such flow. For this purpose, the cross sectional flow area of the passages 45, 46 and 48 are designed so that the desired damping effect is impressed on the hydraulic medium flowing through them. Accordingly, when the flow through channels 45, 46 and 48 are designed to have a constant flow section over their axial length, as in the example per FIGS. 1*a* to 1*c*, they form over their entire axial length, damping sections in which the throttling effect and, therefore, the hydraulic damping occurs in both the retraction and extension of the inner body 1 and the outer body 2. Instead of such axially long damping sections, otherwise defined damping section of shorter axial length may be provided by a flow restricter within larger passages. This is shown by way of example in FIG. 1*b* and on an enlarged scale in FIG. 2, in which the flow passage 47 is of large annular flow section, while the defined damping point is formed by the upper supporting ring 62 of the lower spring chamber 42, the outside diameter of said ring and the inside diameter of the opposite area of the outer body of Section 12 forming a reduced flow area or damping gap 63. Such a design may be provided, for instance, also in the area of the supporting rings 59, 60 and 61, in which case the connecting channels 45, 46, and 48, respectively, have a wide cross section.

Figure 3:
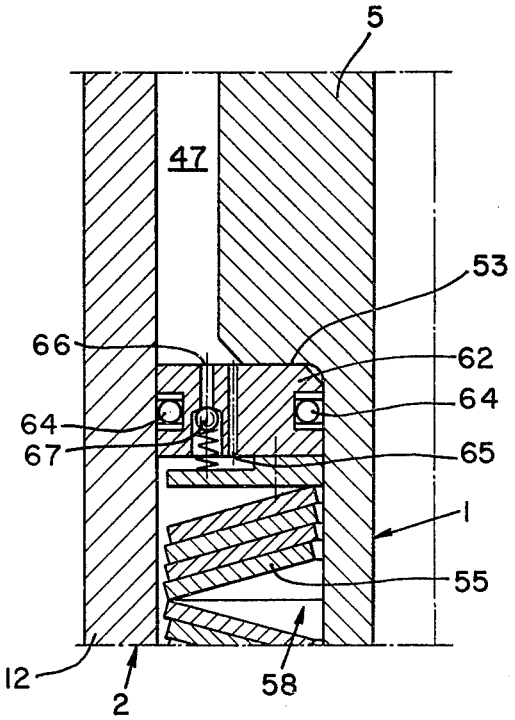
FIG. 3 is a view, similar to FIG. 2 showing a modified embodiment.
Figure 4:
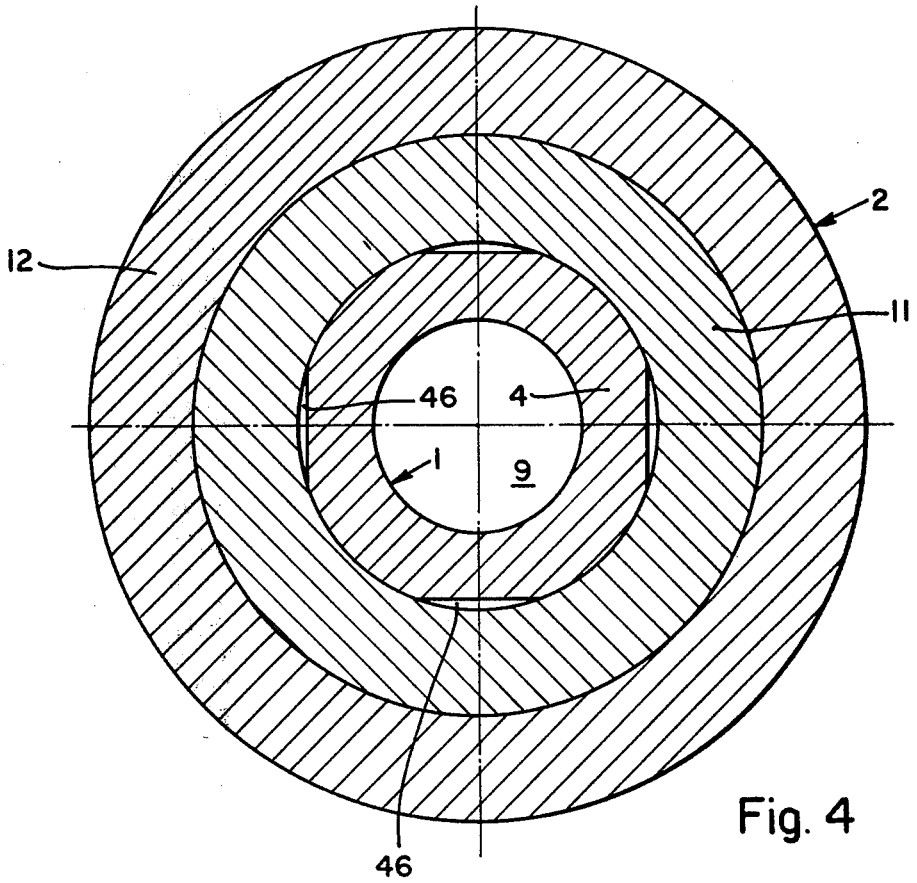
FIG. 4 is an enlarged view in cross section along the line IV—IV in FIGS. 1*b* and 5, respectively.
Figure 5:
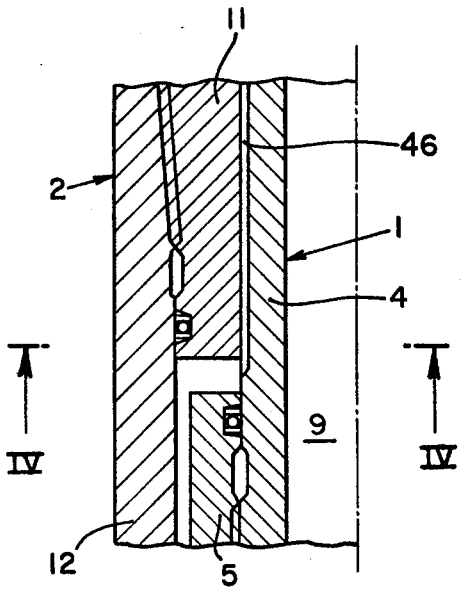
FIG. 5 is an enlarged partial view in the region intersected by the line IV—IV in FIG. 1*b.

A modified form of the invention is depicted in FIG. 3, in which the supporting ring 62 has its inner and its outer periphery sealed by means of a seal 64 against the inner and outer bodies and has flow passages 65 forming a damper when hydraulic fluid flows therethrough on the retraction of the outer and inner body parts. In addition, the supporting ring 62, in FIG. 3, has a flow passage 66 offering no or reduced damping effect when hydraulic fluid flows in one direction (from top to bottom) and blocking the flow in the opposite direction by means of a check valve 67. Such a design provides for a damping effect by damping the hydraulic fluid only when flowing in one direction, whereas in the opposite flow direction, there is no damping action or damping only to a reduced degree. This makes it possible to vary the damping effect during the retraction of the inner body 1 and the outer body 2 from the damping effect during their extension. The design of the flow damper in FIG. 3 is only an example to illustrate the possibilities for varying the damping effect as a function of the direction of movement of the shock absorber bodies. It is apparent that other suitable valve designs may be employed, it being possible also to provide only flow passage 66 and the supporting ring 62, which can then be closed more by the valve means when the hydraulic means flows in one direction than in the other.

Figure 6:
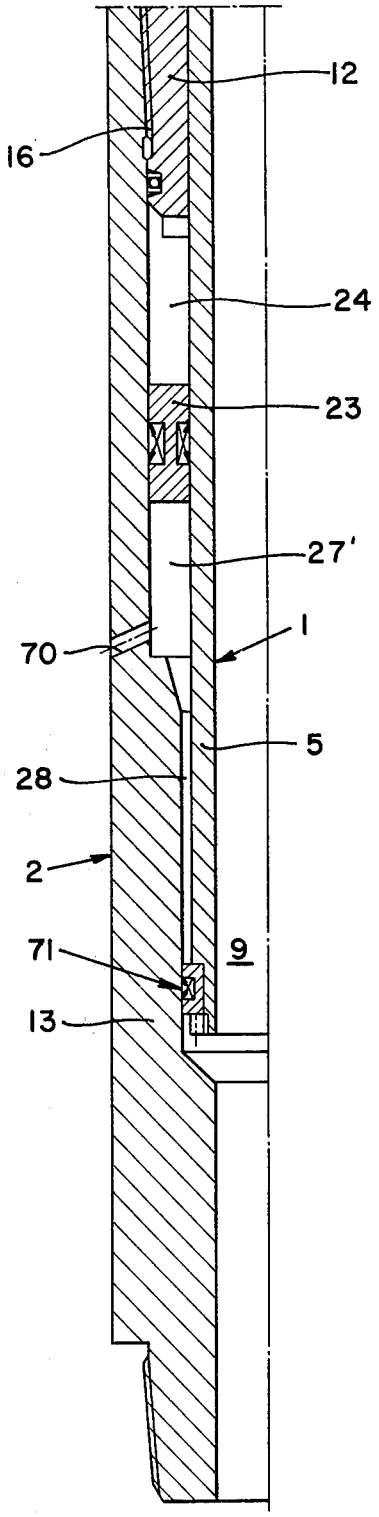
* and FIG. 6 is a fragmentary longitudinal quarter section showing the lower portion of a modified embodiment of the invention.

FIG. 6 shows a modification in the lower end of the shock absorber assembly, where there is provided below the lower equalizer piston 23, which is indicated schematically in FIG. 6, and in chamber 27′ which communicates with the bore hole through connecting port means 70 and is sealed against the entry of drilling fluid from the central tool passage 9. For this purpose, there is inserted between the lower end of section 5 of the inner body 1 and the lower section 13 of the outer body 2, a seal 71 to close off the lower end of the passage 28. The seal 71 is located in an area of even smaller diameter than the diameter 41 for the upper seal 19, thereby achieving, in view of the communication of the chamber 27′ with the drilling fluid in the bore hole, a further reduction of the expansion forces operating between the inner body 1 and the outer body 2.

It will be understood of course that numerous modifications are possible within the scope of the invention. For instance, instead of the two superposed spring column 57, 58, additional parallel-acting columns can be arranged on top of each other. Also, the number of dish-type springs stacked in the same sense in one spring packet can be decreased or increased to suit the desired damping effect. This applies naturally also to the number of spring packets provided in each spring column. Furthermore, the engaging surfaces of the dish-type springs can be provided with a friction or wear reducing coating such as tetrafluorethylene. In cases where relatively easy drilling conditions prevail, the provision of flow dampers for the hydraulic fluid in the annular space 18 may also be omitted, if the natural damping of the dish-type springs suffices due to their friction during the functioning of the shock absorber. Instead of arranging the torque transfer means in the upper shock absorber region, it also is possible to provide it in the lower region of the shock absorber.

I claim:

1. In a shock absorber for use in a well bore rotary drilling pipe string: an outer tubular body and an inner tubular body telescopically coengaged and defining a central flow passage, each body having an outer end connectible in the drill pipe string, torque transfer means between said bodies for rotating said bodies as a unit in said drill pipe string, means including said bodies defining therebetween an annular space filled with hydraulic fluid, spring means in said annular space for shock absorption and attenuation, said means defining said annular space including an upper seal between said bodies and a lower annular equalizer piston resciprocable between said bodies, said bodies defining an equalizer chamber below said equalizer piston communicating with one of the outside of said outer body and said central flow passage, said spring means comprising at least two parallel-acting spring columns in axially spaced relation, annular and axially spaced spring seats on the respective bodies defining a chamber for each spring column, means forming a flow path for said hydraulic fluid between said spring chambers, said spring columns including dish-type spring washers stacked in sets whose stacking sense alternate axially of said columns.

2. In a shock absorber as defined in claim 1; the inside and outside diameters of said dish-type springs of each set in the respective columns being the same.

3. In a shock absorber as defined in claim 1; said dish-type springs having their mutually contacting surfaces coated with wear reducing material.

4. In a shock absorber as defined in claim 1; the inside and outside diameters of said dish-type springs of each set in the respective columns being the same, said dish-type springs having their mutually contacting surfaces coated with wear reducing material.

5. In a shock absorber as defined in claim 1; said dish-type springs of said sets being spaced from said inner and outer bodies to form a gap.

6. In a shock absorber as defined in claim 1; the inside and outside diameters of said dish-type springs of each set in the respective columns being the same, said dish-type springs of said sets being spaced from said inner and outer bodies to form a gap.

7. In a shock absorber as defined in claim 1; said dish-type springs having their mutually contacting surfaces coated with wear reducing material, said dish-type springs of said sets being spaced from said inner and outer bodies to form a gap.

8. In a shock absorber as defined in claim 1; the inside and outside diameters of said dish-type springs of each set in the respective columns being the same, said dish-type springs having their mutually contacting surfaces coated with wear reducing material, said dish-type springs of said sets being spaced from said inner and outer bodies to form a gap.

9. In a shock absorber as defined in claim 1; said spring chambers being fluid pumping chambers of decreasing volume upon telescopic retraction of said bodies and increasing volume upon telescopic extension of said bodies.

10. In a shock absorber as defined in claim 1; said spring chambers being fluid pumping chambers of decreasing volume upon telescopic retraction of said bodies and increasing volume upon telescopic extension of said bodies, the inside and outside diameters of said dish-type springs of each set in the respective columns being the same.

11. In a shock absorber as defined in claim 1; said spring chambers being fluid pumping chambers of decreasing volume upon telescopic retraction of said bodies and increasing volume upon telescopic extension of said bodies, said dish-type springs having their mutually contacting surfaces coated with wear reducing material.

12. In a shock absorber as defined in claim 1; said spring chambers being fluid pumping chambers of decreasing volume upon telescopic retraction of said bodies and increasing volume upon telescopic extension of said bodies, the inside and outside diameters of said dish-type springs of each set in the respective columns being the same, said dish-type springs having their mutually contacting surfaces coated with wear reducing material.

13. In a shock absorber as defined in claim 1; said spring chambers being fluid pumping chambers of decreasing volume upon telescopic retraction of said bodies and increasing volume upon telescopic extension of said bodies, said dish-type springs of said sets being spaced from said inner and outer bodies to form a gap.

14. In a shock absorber as defined in claim 1; said spring chambers being fluid pumping chambers of decreasing volume upon telescopic retraction of said bodies and increasing volume upon telescopic extension of said bodies, said dish-type springs of said sets being spaced from said inner and outer bodies to form a gap, said spring chamber being defined between inwardly facing shoulders on said outer body, outwardly facing shoulders on said inner body and cylindrical walls of said bodies.

15. In a shock absorber as defined in claim 1; said spring chambers being fluid pumping chambers of decreasing volume upon telescopic retraction of said bodies and increasing volume upon telescopic extension of said bodies, said means forming a flow path including axial passages between said spring chambers, and including another axial passage between the lowermost spring chamber and said annular space above said equalizer piston.

16. In a shock absorber as defined in claim 1; said spring chambers being fluid pumping chambers of decreasing volume upon telescopic retraction of said bodies and increasing volume upon telescopic extension of said bodies, said means forming a flow path including axial passages between said spring chambers, and including another axial passage between the lowermost spring chamber and said annular space above said equalizer piston, said spring chambers being defined between inwardly facing shoulders on said outer body, outwardly facing shoulders on said inner body and cylindrical walls of said bodies.

17. In a shock absorber as defined in claim 1; said spring chambers being fluid pumping chambers of decreasing volume upon telescopic retraction of said bodies and increasing volume upon telescopic extension of said bodies, said means defining an additional hydraulic fluid filled chamber between said bodies above the uppermost spring chamber and between axially spaced shoulders on said bodies, and including a flow passage through the lowermost of said axially spaced shoulders into said uppermost spring chamber 18. In a shock absorber as defined in claim 1; said spring chambers being fluid pumping chambers of decreasing volume upon telescopic retraction of said bodies and increasing volume upon telescopic extension of said bodies, said dish-type springs of said sets being spaced from said inner and outer bodies to form a gap, said spring chambers being defined between inwardly facing shoulders on said outer body, outwardly facing shoulders on said inner body and cylindrical walls of said bodies, means defining an additional hydraulic fluid filled chamber between said bodies above the uppermost spring chamber and between axially spaced shoulders on said bodies, and including a flow passage through the lowermost of said axially spaced shoulders into said uppermost spring chamber.

19. In a shock absorber as defined in claim 1; said spring chambers being fluid pumping chambers of decreasing volume upon telescopic retraction of said bodies and increasing volume upon telescopic extension of said bodies, said means forming a flow path including axial passages between said spring chambers, and including another axial passage between the lowermost spring chamber and said annular space above said equalizer piston, means defining an additional hydraulic fluid filled chamber between said bodies above the uppermost spring chamber and between axially spaced shoulders on said bodies, and including a flow passage through the lowermost of said axially spaced shoulders into said uppermost spring chamber.

20. In a shock absorber as defined in claim 1; a hydraulic fluid flow damper for restricting fluid flow in said annular space.

21. In a shock absorber as defined in claim 9; a hydraulic fluid flow damper for restricting fluid flow in said annular space.

22. In a shock absorber as defined in claim 1; said spring chambers being fluid pumping chambers of decreasing volume upon telescopic retraction of said bodies and increasing volume upon telescopic extension of said bodies, the inside and outside diameters of said dish-type springs of each set in the respective columns being the same, a hydraulic fluid flow damper for restricting fluid flow in said annular space.

23. In a shock absorber as defined in claim 1; said spring chambers being fluid pumping chambers of decreasing volume upon telescopic retraction of said bodies and increasing volume upon telescopic extension of said bodies, said means forming a flow path including axial passages between said spring chambers, and including another axial passage between the lowermost spring chamber and said annular space above said equalizer piston, and a hydraulic fluid flow damper for restricting fluid flow through said axial passages.

24. In a shock absorber as defined in claim 1; said spring chambers being fluid pumping chambers of decreasing volume upon telescopic retraction of said bodies and increasing volume upon telescopic extension of said bodies, said dish-type springs of said sets being spaced from said inner and outer bodies to form a gap, said spring chamber being defined between downwardly facing shoulders on said outer body, upwardly facing shoulders on said inner body and cylindrical walls of said bodies, and a hydraulic fluid flow damper defined between one of said inwardly facing shoulders and the opposing cylindrical wall of one of said bodies.

25. In a shock absorber as defined in claim 1; said spring chambers being fluid pumping chambers of decreasing volume upon telescopic retraction of said bodies and increasing volume upon telescopic extension of said bodies, said means forming a flow path including axial passages between said spring chambers, and including another axial passage between the lowermost spring chamber and said annular space above said equalizer piston, at least one of said axial passages being restricted to form a hydraulic fluid flow damper, said at least one of said flow passages having a constant cross sectional area throughout its length.

26. In a shock absorber as defined in claim 1; said spring chambers being fluid pumping chambers of decreasing volume upon telescopic retraction of said bodies and increasing volume upon telescopic extension of said bodies, said means forming a flow path including axial passages between said spring chambers, and including another axial passage between the lowermost spring chamber and said annular space above said equalizer piston, at least one of said axial passages being restricted to form a hydraulic fluid flow damper, said at least one of said flow passages having a cross sectional area constricted in only a limited section of the axial length thereof.

27. In a shock absorber as defined in claim 1; said spring chambers being fluid pumping chambers of decreasing volume upon telescopic retraction of said bodies and increasing volume upon telescopic extension of said bodies, said means forming a flow path including axial passages between said spring chambers, and including another axial passage between the lowermost spring chamber and said annular space above said equalizer piston, each of said axial passages being constricted to form hydraulic fluid flow dampers for restricting fluid flow in said annular space.

28. In a shock absorber as defined in claim 27; the restrictions in said axial passages being the same.

29. In a shock absorber as defined in claim 27; the restrictions in said flow passages differing in their damping effect as a function of the direction of fluid flow.

30. In a shock absorber as defined in claim 1; said spring chambers being fluid pumping chambers of decreasing volume upon telescopic retraction of said bodies and increasing volume upon telescopic extension of said bodies, one of said spring seats comprising a ring sealingly engaged with said inner and outer bodies and having an axial flow passage from a hydraulic fluid flow damper for restricting said fluid flow in said annular space.

31. In a shock absorber as defined in claim 1; said spring chambers being fluid pumping chambers of decreasing volume upon telescopic retraction of said bodies and increasing volume upon telescopic extension of said bodies, one of said spring seats comprising a ring sealingly engaged with said inner and outer bodies and having an axial flow means therethrough for allowing relatively free flow of fluid in one direction and restrictable by valve means to reduce fluid flow in the other direction.

32. In a shock absorber as defined in claim 1; another seal between said bodies above said upper seal, said bodies defining another annular space therebetween said upper seal and said another seal, another annular equalizer piston reciprocable in said another annular space and forming with said another seal another chamber filled with hydraulic fluid, one of said bodies having part means for exposing the lower end of said another equalizer piston to the pressure of drilling fluid, said torque transfer means being located in said another chamber.

33. In a shock absorber as defined in claim 32; the sealing diameter of said inner body at said upper seal being smaller than the sealing diameter of said inner body at said another seal.

34. In a shock absorber as defined in claim 32; the sealing diameter of said inner body at said upper seal being smaller than the sealing diameter of said inner body at said another seal, said outer body having port means below the first equalizing piston for communicating between the outside of said outer body and the first annular space, and including another lower seal between said bodies below said port means.

* * * * *